US007067728B2

(12) United States Patent
Huang

(10) Patent No.: US 7,067,728 B2
(45) Date of Patent: Jun. 27, 2006

(54) SPRING OPERATED RECORD PLAYER ORGAN

(75) Inventor: Lung-Hsi Huang, Dali (TW)

(73) Assignee: Kyooh Precision Industry Co., Ltd., Taichung Hsien (TW)

( * ) Notice: Subject to any disclaimer, the term of this patent is extended or adjusted under 35 U.S.C. 154(b) by 0 days.

(21) Appl. No.: 10/902,110

(22) Filed: Jul. 29, 2004

(65) Prior Publication Data

US 2006/0021489 A1 Feb. 2, 2006

(51) Int. Cl.
*G10F 1/06* (2006.01)

(52) U.S. Cl. ..... 84/95.1

(58) Field of Classification Search ..... 84/94.1, 84/94.2, 95.1, 95.2, 96, 97, 98, 99, 100, 101
See application file for complete search history.

(56) References Cited

U.S. PATENT DOCUMENTS 5,877,439 A * 3/1999 Asakawa et al. ..... 84/95.1
6,323,404 B1 * 11/2001 Hayashi ..... 84/94.1

* cited by examiner

*Primary Examiner*—Kimberly Lockett
(74) *Attorney, Agent, or Firm*—Alan D. Kamrath; Nikolai & Mersereau, P.A.

(57) ABSTRACT

A spring operated record player organ includes a base apparatus, a driving unit, a gear set, a fixed axle unit, a record player, and a rotation speed governor. The record player is able to rotate with the stable restoring force of a manually wound up coil spring so as to play rhythmical music pleasant to the ear. As this apparatus does not require electric power, it is conveniently usable anywhere.

4 Claims, 4 Drawing Sheets

SPRING OPERATED RECORD PLAYER ORGAN

BACKGROUND OF THE INVENTION

1. Field of the Invention

The present invention relates to a record player organ and, more particularly, to a record player organ which is driven by the restoring force of a spring.

2. Description of the Prior Art

FIG. 4, is a schematic view of a conventional motor operated record player organ. As shown in FIG. 4, a comb leaf spring 71 is provided on a base apparatus 7. A set pin 72 and a driving motor 73 are, respectively, installed on each side of the comb leaf spring 71. The driving motor 73 is geared with a double helical gear 74, while the double helical gear 74 is geared with a ratchet wheel 75. Several pawl wheels 751 and a player driving gear 752 are coaxially installed on the shaft of the ratchet wheel 75 in order. The player driving gear 752 is for driving a record player.

The base apparatus 7 installed at one side of the motor 73 has a fixed axle 76. A hasp 761 is provided at the terminal end of the fixed axle 76 so as to fasten the fixed axle 76 to the set pin 72.

When it is intended to play music, the record player is set on the set pin 72. The hasp 761 is engaged with the set pin 72 such that the record player is set between the ratchet wheel 75 and the fixed axle 76. The motor 73 is energized from the power source so as to drive the double helical gear 75 and the player driving gear 752 which in turn drives the record player to rotate. By mutual action between the apertures formed on the record player and the driving gear 752, the comb leaf spring 71 is actuated to play rhythmical music.

However, the conventional spring operated record player organ constructed as such has the following shortcomings, namely:

1. A power supply is necessary to operate this apparatus. Thus, it is unable to play where there is no available power source.

2. Electrical wiring is necessary in the apparatus that makes its construction complicated and frangible. Thus, very careful attention for operation and transportation is required.

As these shortcomings are noticeable on the prior art, an improvement is seriously required.

A novel spring operated record player organ as provided in this invention eliminates the shortcomings mentioned above.

SUMMARY OF THE INVENTION

It is an object of the present invention to provide a spring operated record player organ which is operated with a spring wound around a rotating shaft Thus, the record player is driven by a restoring force of the spring instead of an extra power supply.

SUMMARY OF THE INVENTION

Another object of the present invention is to provide a spring operated record player organ whose rotating shaft is erected to pierce through the spring cover and the base apparatus. A rotary switch to twist the coil spring is provided on the top end of the rotating shaft so as to wind up the coil spring before rotating the record player.

Another object of the present invention is to provide a spring operated record player organ capable of operating only by the restoring force of the spring so that the organ is usable anywhere and anytime without seeking another power supply.

Another object of the present invention is to provide a spring operated record player organ which does not have to be turned up side down for operation by providing a rotary switch on the spring cover to twist the spring. The assembly process is facilitated by placing the base apparatus horizontally on a bottom plate when assembling the organ in the mechanism.

To achieve these and other objects mentioned above, the present invention includes a base apparatus, a driving unit, a gear set, a fixed axle unit, a record player, and a rotation speed governor.

The base apparatus is composed of a comb leaf spring, a ratchet wheel shaft provided with equal numbers of actuating ratchet wheels as that of the teeth of the comb leaf spring, and a player driving gear. All of the actuating ratchet wheels and the player driving gear are coaxially coupled to the ratchet wheel shaft. The comb leaf spring and the ratchet wheel shaft are mutually coupled in a state such that the actuating ratchet wheels can tap the teeth of the comb leaf spring to output various octavant musical sound.

The driving unit has a spring cover fitted at one side of the base apparatus. The spring cover has a rotating shaft piercing through its top surface. A first crown gear is enclosed underneath the spring cover. A rotary switch is provided at the other side where the rotating shaft is coupled with the first crown gear. A coil spring is wound around the rotating shaft. The rotary switch is utilized to wind up the coil spring. When the rotary switch is released, the restoring force of the coil spring drives the rotating shaft to rotate which in turn drives the first crown gear.

The gear set is equipped between the comb leaf spring and the driving unit. The gear set is composed of a second crown gear, a first step spur gear, a second step spur gear, a double helical gear, and a speed reducer. As the first and second crown gears are in mesh with each other, the rotation of the first crown gear puts the gear set in motion which in turn drives the ratchet wheel shaft. Thereby, all the ratchet wheels are actuated to tap the comb leaf spring.

The fixed axle unit is provided with a set pin and a fixed axle. The set pin is located in the base apparatus at the position distantly apart from the driving unit and extended in the direction apart from the base apparatus. One end of the set pin is pivoted to the spring cover. The other end of the set pin is provided with a hasp to fasten the fixed axle in parallel with the ratchet wheel shaft. Additionally, several rotating wheels are fitted with the fixed axle coaxially in series.

A record player is provided with a drilled hole formed at its center to allow the set pin to pierce there through. The record player is provided with a plurality of tapping apertures distributed at random on its surface. A plurality of driving holes are formed around the record player at the positions near its fringe. Thus, when the record player is driven to rotate by the player driving gear, the driving holes formed around the fringe of the record player will never fail to mesh with the player driving gear since the record player is pressed by the rotating wheels of the fixed axle.

The rotation speed governor is provided beneath the bottom apparatus and the driving unit. It is composed of a speed stabilizing cam and a speed stabilizing wheel. The speed stabilizing cam is mated with the rotating shaft at the end distantly apart from the rotary switch for the coil spring.

Additionally, the speed stabilizing wheel is in mesh with the speed stabilizing cam. With the aid of the rotation speed governor, the operation of the mechanism is defined to take place during the time interval the restoring force of the coil spring is at the most stable state. Thus, the music can be played pleasantly to the ear with the stabilized rotating speed of the mechanism.

BRIEF DESCRIPTION OF THE DRAWINGS

The drawings disclose an illustrative embodiment of the present invention which serves to exemplify the various advantages and objects hereof and are as follows.

DETAILED DESCRIPTION OF THE PREFERRED EMBODIMENT

Figure 1:
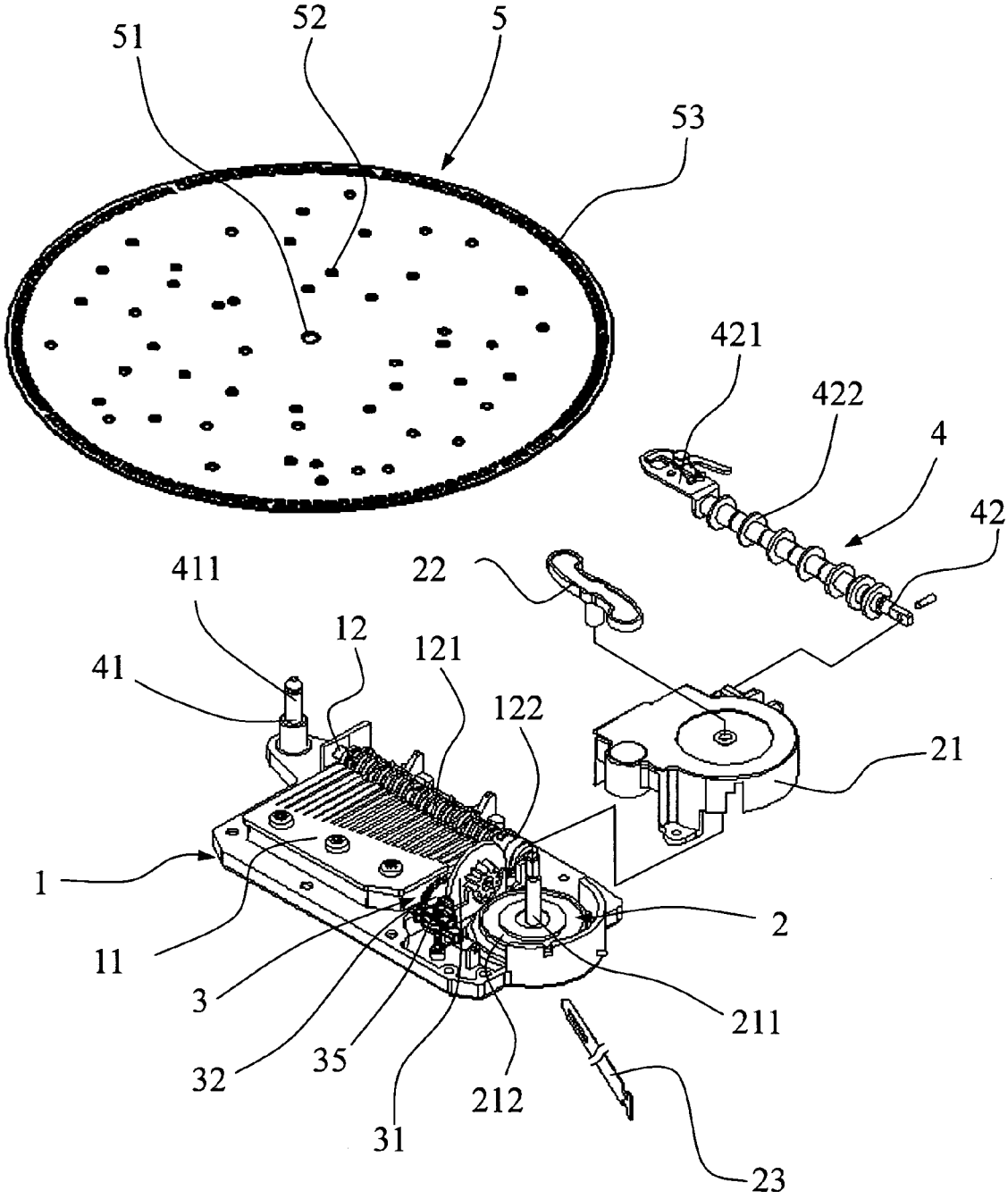
FIG. 1 is an illustrative exploded view of the present invention.
Figure 2:
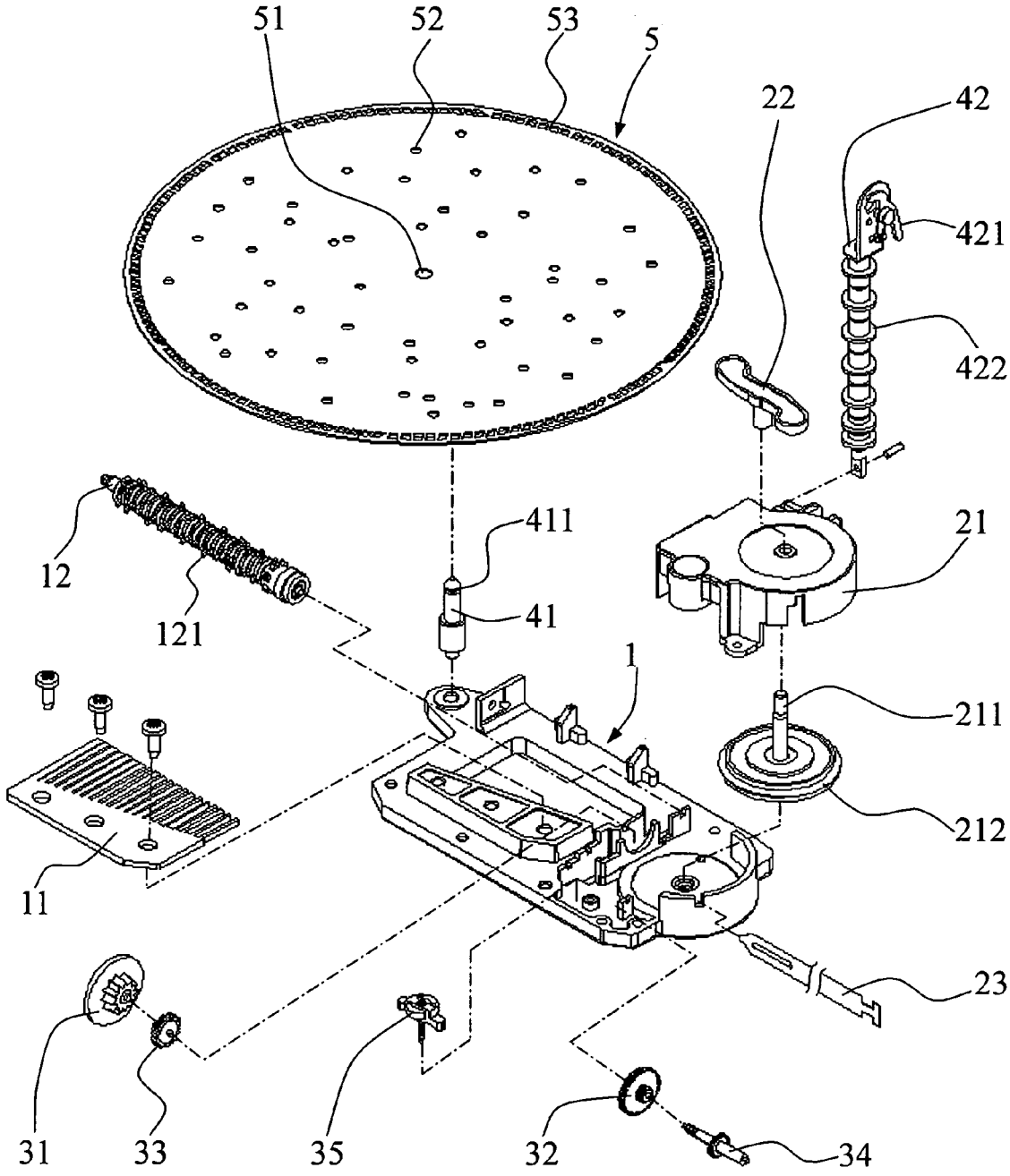
FIG. 2 is another illustrative exploded view of the present invention.
Figure 3:
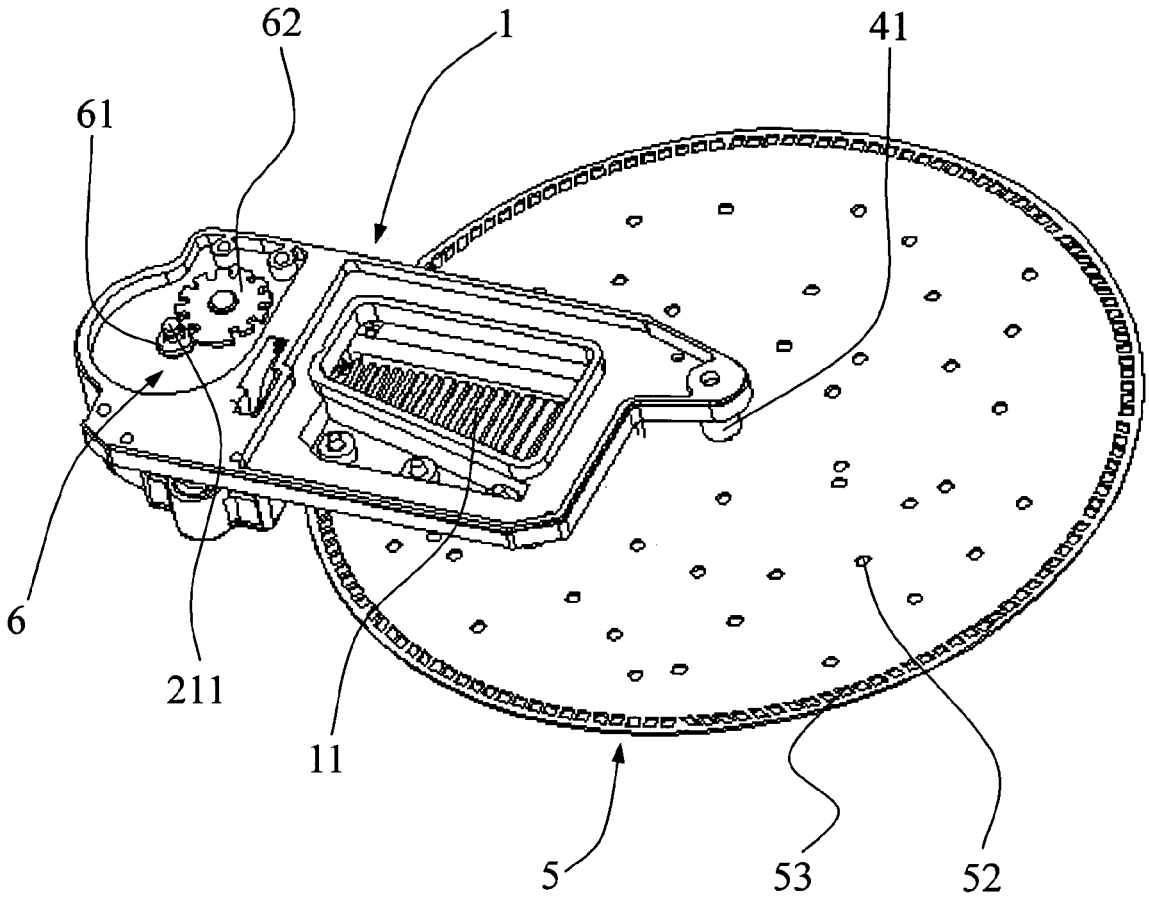
FIG. 3 is a perspective view of the present invention observed downwardly.
Figure 4:
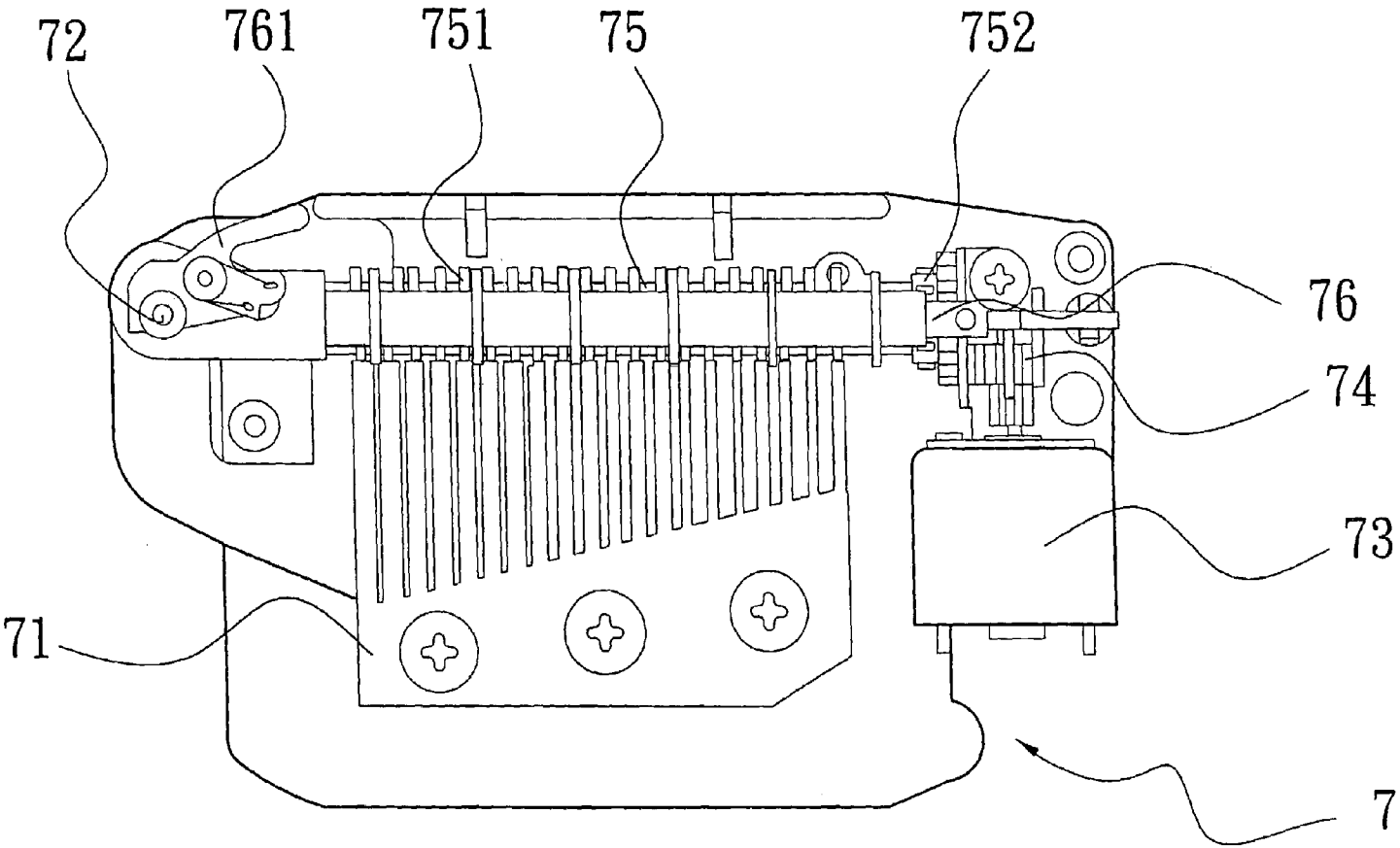
Fig. 4 (PRIOR ART)
FIG. 4 is a schematic view of a conventional spring operated record player organ.

Referring to FIG. 1 through FIG. 3, the spring operated record player organ comprises a base apparatus 1, a driving unit 2, a gear set 3, a fixed axle unit 4, a record player 5, and a rotation speed governor 6.

The base apparatus 1 is composed of a comb leaf spring 11 and a ratchet wheel shaft 12. The ratchet wheel shaft 12 is provided with actuating wheels 121 and a player driving gear 122, whit both coaxially fitted to the ratchet wheel shaft 12. The comb leaf spring 11 is equipped at a position where it can be tapped by the actuating wheels 121 to output a rhythmical music when the ratchet wheel shaft 12 rotates.

The driving unit 2 has as spring cover 21 fitted at one side of the base apparatus 1. The spring cover 21 has a rotating shaft 211 piercing through its top surface. A first crown gear 212 is enclosed underneath the spring cover 21. A rotary switch 22 is provided at the other side where the rotating shaft 211 is coupled with the first crown gear 212. A coil spring 23 is wound around the rotating shaft 211. The rotary switch 22 is used to wind up the coil spring 23. When the wound coil spring 23 is released, the restoring force of the coil spring 23 drives the rotating shaft 211 which, in turn, drives the first crown gear 212.

The gear set 3 is equipped between the comb leaf spring 11 and the driving unit 2. The gear set 3 is composed of a second crown gear 31, a first step spur gear 32, a second step spur gear 33, a double helical gear 34, and a speed reducer 35. As the first and second crown gears 212 and 31 are in mesh with each other, the rotation of the first crown gear 212 puts all component parts included in the gear set 3 (second crown gear 31, first step spur gear 32, second step spur gear 33, double helical gear 34, speed reducer 35) in motion. The second step spur gear 33 mated with the second crown gear 31 then, in turn, drives the ratchet wheel shaft 12. Thereby, all of the ratchet wheels 121 are actuated to tap the comb leaf spring 111 with a proper rotating speed under control of the speed reducer 35.

The fixed axle unit 4 is provided with a set pin 41 and a fixed axle 42. The set pin 41 is located in the base apparatus 1 at the position distantly apart from the driving unit 2 and extended towards the direction apart from the base apparatus 1. One end of the set pin 41 is pivoted to the spring cover 21. The other end of the set pin 41 is provided with a hasp 421 to be inlaid into a circular slot 411 formed around the upper portion of the set pin 41 so as to fasten the fixed axle 4 in parallel to the ratchet wheel shaft 12. Additionally, several rotating wheels 422 are fitted with the fixed axle 42 coaxially in series.

A record player 5 is provided with a drilled hole 51 formed at its center to allow piercing the set pin 41 therethrough. A plurality of tapping apertures 52 are distributed at random on the surface of the record player 5. A plurality of driving holes 53 are formed around the record player 5 at the position near its fringe thereof. Thus, when the record player 5 is driven to rotate by the player driving gear 122, the driving holes 53 are able to positively mate with the player driving gear 122, since the record player 5 is pressed by the rotating wheels 422 of the fixed axle 42.

The rotation speed governor 6 is provided beneath the base apparatus 1 and the driving unit 2. As shown in FIG. 3, it is composed of a speed stabilizing cam 61 and a speed stabilizing wheel 62. The cam 61 is mated with the rotating shaft 211 at the end distantly apart from the rotary switch 22 for the coil spring 23. Additionally, the wheel 62 is in mesh with the cam 61. With the aid of the rotation speed governor 6, the operation of the mechanism is defined to take place during the time interval the restoring force of the coil spring 23 is at its most stable condition. Thus, the music can be played pleasantly to the ear with a stabilized rotating speed of the record player 5.

The speed stabilizing wheel 62 of the rotation speed governor 6 has a plurality of equally sized, equally spaced, similarly shaped teeth and one differently shaped tooth. The number of similarly shaped teeth matches with the length of the coil spring 23 and the stable restoring force acting time interval of the coil spring 23.

To operate the mechanism of the present invention, the mechanism is put on a platform or a desk. The hasp 421 is released from the circular slot 411 formed around the set pin 41. The drilled hole 51 of the record player 5 is inserted onto the set pin 41. Then, the hasp 421 is again inlaid into the circular slot 411 so as to mate the player driving gear 122 on the ratchet wheel shaft 12 with the driving holes 53 formed along the fringe of the record player 5. With the aid of the rotating wheels 422 of the fixed axle 42 pressed onto the record player 5, the driving holes 53 keep in mesh with the gear 122 without the worry of disengagement. The rotate the rotary switch 22 is rotated to wind the coil spring 23 around the rotating shaft 211 thereby storing the energy in the twisted coil spring 23.

After releasing the rotary switch 22, the mutually mated speed stabilizing wheel 62 and cam 61 begin to rotate together until reaching the last tooth. The coil spring 23 is able to drive the first and second crown gear 212 and 31 depending on its own restoring force. The gear set 3 is in turn actuated to rotate and drive the player driving gear 122 so that the record player 5 is driven to rotate. As the record player 5 rotates, the combined action of the driving holes 53 and the actuating wheels 121 makes the latter to tap the comb leaf spring 11 to output a pleasant rhythmical music. For stabilizing the operation of the mechanism of the present invention, action of the speed stabilizing wheel 62 and cam 61 cooperate to define the operation of the mechanism to take place during the time interval the restoring force of the coil spring 23 is at its most stable condition so that the music can be played pleasantly to the ear.

In addition, the position of the actuating holes 53 on the player 5 can be varied in accordance with the different melody so that it provides the individual user with a wide selection.

It emerges from the above description that the spring operated record player organ has several noteworthy advantages compared with that made of any conventional technique, namely:

1. The mechanism is operated by a manually twisted coil spring associated with several gear combinations so that any other extra power supply such as utility power or a battery unit is not necessary.

2. The rotary switch for twisting the coil spring is provided on top of the rotating shaft so it is convenient to wind up the coil spring without tampering with the base apparatus before rotating the record player.

3. The operation of the mechanism is defined to take place during the time interval the restoring force of the coil spring is at its most stable condition thereby the music can be played pleasantly to the ear.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A spring operated record player organ comprising:

a base apparatus, a driving unit, a gear set, a fixed axle unit, a record player, and a rotation speed governor; wherein said base apparatus includes a comb leaf spring having a plurality of teeth, a ratchet wheel shaft provided with equal numbers of actuating ratchet wheels as that of the plurality of teeth of said comb leaf spring, and a player driving gear, with all of said actuating ratchet wheels and said player driving gear coaxially coupled to said ratchet wheel shaft, said comb leaf spring and said ratchet wheel shaft mutually coupled in a state such that said actuating ratchet wheels can tap the plurality of teeth of said comb leaf spring to output a various octavant musical sound;

with the driving unit having a spring cover fitted at one side of said base apparatus, wherein said spring cover has a rotating shaft piercing through a top surface of the spring cover, a first crown gear enclosed underneath said spring cover, a rotary switch provided above the spring cover, wherein said rotating shaft is coupled with said first crown gear, and a coil spring wound around said rotating shaft, wherein said rotary switch is utilized to wind up said coil spring, wherein when said rotary switch is released, restoring force of said coil spring drives said rotating shaft to rotate which in turn drives said first crown gear;

with the gear set equipped between said comb leaf spring and said driving unit, said gear set composed of a second crown gear, a first step spur gear, a second step spur gear, a double helical gear, and a speed reducer, wherein said first and second crown gears are in mesh with each other, wherein rotation of said first crown gear puts said gear set in motion which in turn drives said ratchet wheel shaft thereby all said ratchet wheels are actuated to tap said comb leaf spring;

said fixed axle unit provided with a set pin and a fixed axle, said set pin located in said base apparatus at a position distantly apart from said driving unit and extending away from said base apparatus, wherein one end of said set pin is pivoted to said spring cover, while another end of said set pin is provided with a hasp to fasten said fixed axle in parallel with said ratchet wheel shaft, with several rotating wheels fitted with said fixed axle coaxially in series;

with the record player including a drilled hole formed at a center of the record player, with said set pin piercing through the drilled hole, said record player provided with a plurality of tapping apertures distributed at random on a surface of the record player, and a plurality of driving holes formed around said record player at positions near a fringe of the record player, wherein said record player is driven to rotate by said player driving gear;

with the rotation speed governor being provided beneath said base apparatus and said driving unit, with the rotation speed governor including a speed stabilizing cam and a speed stabilizing wheel, said speed stabilizing cam mated with said rotating shaft at an end distantly apart from said rotary switch said speed stabilizing wheel in mesh with said speed stabilizing cam.

2. The spring operated record player organ of claim 1, wherein said speed reducer is equipped between said spring cover and said base apparatus.

3. The spring operated record player organ of claim 1, wherein said speed stabilizing wheel of said rotation speed governor has a plurality of equally sized, equally spaced, similarly shaped teeth and one differently shaped tooth, the plurality of similarly shaped teeth is of a number matching with a length of said coil spring.

4. The spring operated record player organ of claim 1, wherein a slot is formed around the upper portion of said set pin for a hasp to be inlaid.

* * * * *